United States Patent [19]

Soles, Jr.

[11] Patent Number: 4,928,971

[45] Date of Patent: May 29, 1990

[54] ALIGNMENT SYSTEM

[76] Inventor: Thomas D. Soles, Jr., 3412 Porter St., N. W., Washington, D.C. 20016

[21] Appl. No.: 332,977

[22] Filed: Apr. 4, 1989

[51] Int. Cl.[5] ..... A63B 69/36; A63B 53/04

[52] U.S. Cl. ..... 273/164; 273/183 E; 33/286

[58] Field of Search ..... 273/163 R, 164, 183 D, 273/183 E; 33/286, 297, 289; D21/219

[56] References Cited

U.S. PATENT DOCUMENTS

| | | | |
|---|---|---|---|
| 3,548,504 | 12/1970 | Sykes | 273/183 E X |
| 4,032,156 | 6/1977 | Clarke | 273/164 |
| 4,043,562 | 8/1977 | Shillington | 273/164 |
| 4,136,877 | 1/1979 | Antonious | 273/164 |
| 4,340,229 | 7/1982 | Stuff, Jr. | 273/164 |
| 4,458,900 | 7/1984 | Antonious | 273/164 |
| 4,461,482 | 7/1984 | Bojicic | 273/183 D |
| 4,722,528 | 2/1988 | Tsao | 273/164 |

*Primary Examiner*—William H. Grieb
*Assistant Examiner*—Sebastiano Passaniti

[57] ABSTRACT

A visual alignment system is disclosed for use in golf clubs, especially putters, which allows for easy and rapid alignment of the golf club with the invisible line for the ball to travel. An indicia is placed on the top surface of the club, at a right angle to the club face at the point of impact, and a second indicia at right angle to the first indicia line parallel to the face of the club. At the intersection of the two indicia lines, a conical cavity occurs, with the apex of the cavity at the intersection point, and the indicia lines continue down the walls of the depression meeting at the apex. When the lines in the depression are viewed from above, alignment will be determined if the intersecting lines are at right angles.

6 Claims, 1 Drawing Sheet

ALIGNMENT SYSTEM

This invention concerns a system for the visual alignment of a unit to insure that it is in proper position for use. In particular, the invention relates to improvements in golf clubs, and especially putters containing this unit to properly position the face of the putter prior to commencing the stroke.

Putting is one of the most important aspects of the game of golf, with the use of the putter being used on every hole of the game, unless the golf ball is unexpectly knocked in from off the green. Therefore the putting club, or putter, must be accurately aligned with the hole, the ball, and the conture of the surface. If the alignment is not correct, the ball will not go into the hole. Between the ball and the hole lies an imaginary line upon which the player desires his ball to traverse and enter the hole. In order for the ball to follow this imaginary line, the club must be properly positioned to impact the ball at the proper location and with the club head in proper vertical position so the impact between ball and club will cause the ball to roll in a straight line to the hole. In the event the club head is not in a vertical position the ball will jump upon impact due to non-vertical position or be forced downwards, causing bouncing. In either case, the ball will most likely deviate from that desired invisible line. Also, if the angle between the blade and ball is not perpendicular to the imaginary line the ball will drift left or right of the line missing the hole, and requiring an additional stroke or more. Clubhead alignment is critical to successful putting and an object of the present invention is to provide an alignment system for easy and accurate positioning of golf club putters at the start of the putting stroke.

Many devices and indicators have been proposed to assist in the alignment of the putter face with the impact point of the ball to assist in the putting stroke. See, for example Antonuous, U.S. Pat. Nos. 4,136,877 and 4,458,900 which provide a system for the alignment of the loft of the club and the lie position of the club, through the alignment of indicia on separate and distanct planes of the club. If eyesight and focus of the player is good, the system can be utilized. See also Clarke, U.S. Pat. No. 4,032,156 wherein stepped colored bands allow the alignment of the club. Other systems have also been described in the literature.

It is an object of this invention to provide a system that is simple and easily utilized by a player, using only a single reference point to properly position his or her club prior to the stroke.

SUMMARY OF THE INVENTION

The present invention relates to a system for golf club alignment, especially for putters, that places on the upper surface of the putter, an indicia line at right angle to the face of the putter, and a second indicia line at right angle to the first indicia, said second indicia parallel to the putter's face. Where the indicia intersect, a cone-like depression is embedded into the top face of the putter, and the indicias are placed on the surface of the walls of the cavity intersecting at the apex of the cone like cavity. If the player viewing the indicia line on the putter observes that all lines are straight, the club is in the proper position for the stroke. In the event that the indicia lines are not straight, then the club is improperly positioned and must be adjusted to obtain the proper view before commencing the putting stroke.

DESCRIPTION OF THE PREFERRED EMBODIMENTS

Figure 1:
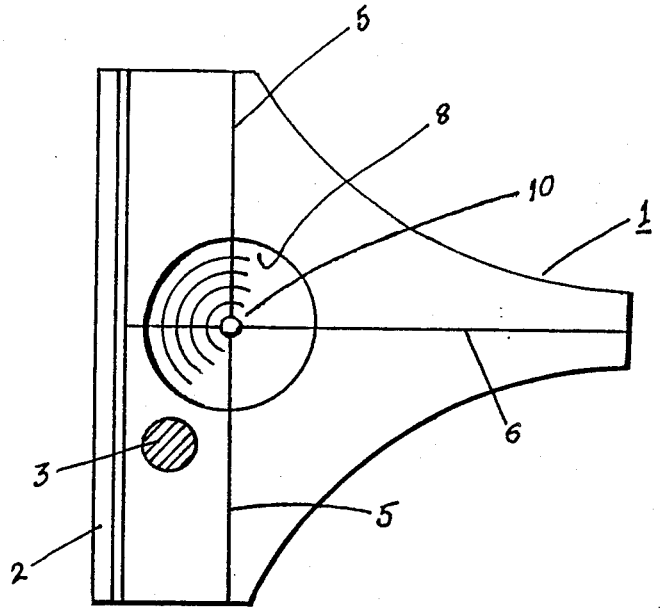
FIG. 1 is a top view of the club head and alignment system of the present invention.
Figure 2:
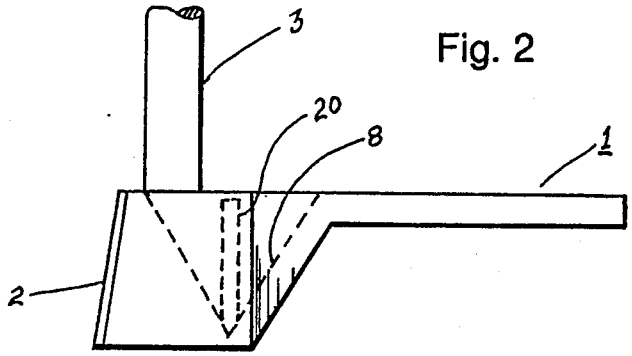
FIG. 2 is a side view of the embodiment shown in FIG. 1.

FIGS. 1 and 2 illustrate a golf club, a putter, with the alignment system of the present invention. FIG. 1 shows a top view of the club head 1, with the face of the club 2, which is to be aligned with the ball prior to striking. The impact area of the ball and club face should occur where indicia line 6 meets the club face 2. Indicia line 5 is parallel to the club face 2, but removed therefrom, passing near the shaft of the club 3. At the intersection of lines 5 and 6, a conical depression 8, is placed in the club, and the indicia lines 5 and 6 continue on the surface of the conical depression 8, intersecting at the apex of the conical depression, 10.

When the alignment of the club is proper, lines 5 and 6, viewed by the player from above will be two straight lines intersecting at 10. If the alignment is not correct, only one of the lines, either 5 or 6 will be straight while the other will appear to the viewer to bend towards the apex 10 of conical indentation in the club. By careful movement of the club, through movement of the club shaft, the indicia line that was not a straight line, will become straight and the intersection of lines 5 and 6 will form 90° angles at point 10 indicating that the club is properly positioned for the commencement of the stroke.

Figure 3A:
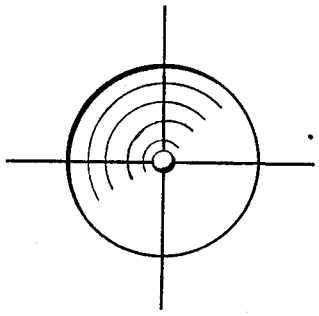
FIGS. 3A, 3B , and 3C illustrates the view to the player when the alignment is proper and improper.
Figure 3B:
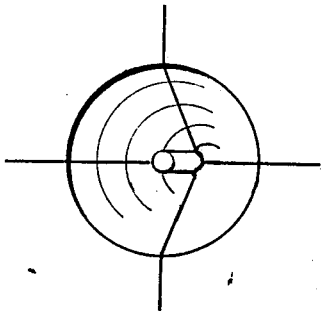
Figure 3C:
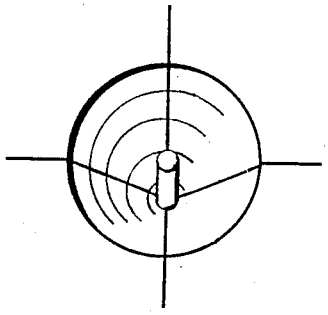

This misalignment of the club, as viewed by the player is shown in FIG. 3. FIG. 3*a* shows a proper alignment, and FIGS. 3*b* and 3*c* shows improper alignment.

The shape of the club shown in FIGS. 1 and 2 are merely one embodiment of the invention and was so selected to allow for indicia 6, to be longer than indicia 5, to provide improved visibility of the player in his selection of that invisible line he or she desires the ball to follow to the hole. The shaft of the putter may be straight, curved, and of a length suitable for the player.

The conical shaped depression 8, may be of a different color than the upper surface of the club, and the indicia lines may be colored to assist in the viewing by the player. The selection of colors may vary depending upon the visual image desired by the player, and to assist in the rapid and accurate determination of the proper positioning of the club.

In FIG. 2, the club face 2 has been depected as having a non-vertical striking surface, but this is a variation of club design and does not affect the alignment system as herein described.

In FIG. 3, the view observed by the player, when the club is properly aligned is shown in FIG. 3*a*, whereas the view shown in FIG. 3*b*, illustrates when the club is tilted forward and in FIG. 3*c*, when the club is tilted to the right. If line 6 in FIG. 3*c*, appeared to the player to be bent in the opposite direction, the club would be tilted to the left.

It is of course, possible for lines 5 and 6 both to be non-straight to the player's view and then by repositioning the club head would correct this and properly position the club for the putting stroke.

The lower surface of the golf club, or its sole, shall be of a sufficient size to provide stability to the club while resting on the putting surface, but does not have to be identical with the size of the upper surface of the club, and is left to the discretion of the builder.

The conical depression 8, may be molded into the club, or may be placed therein at a later stage of manufacture. The size of the conical depression should be of a size allowing easy visibility to the player and will depend in part upon the size of the indicia lines and the use of color. The slope of the conical depression may be varied to suit the design of the upper surface of the club, and any colors that may be used thereon. The acute angle formed by the slope of conical wall and the upper surface of the club may range from 30° to 60°.

An additional embodiment of the invention is shown in FIG. 2, wherein at the apex of the depression, 10, a post, 20, is placed rising perpendicular toward the top surface of the putter. This post shall be of a diameter slightly larger than the width of the indicia lines and of a highth extending from the apex near to the top surface. This hight will be dependant upon the size of the depression, angle of the depression and the diameter of the post. The post can be colored with a contrasting color of the indicia lines on the upper club surface or the depression in order to assist the player to properly align the club in accordance with the invention.

What is claimed is:

1. An alignment system for a golf club to allow a player to establish alignment in a precise manner, said golf club having a ball striking face, a lower surface, and an upper surface parallel to said lower surface, said upper surface comprising:

(a) a first indicia line extending substantially across the length of the upper surface parallel to the ball striking face, but removed from said face;

(b) a second indicia line extending substantially across the width of the upper surface perpendicular to the ball striking face and intersecting said first indicia line;

(c) a conical depression formed at the intersection of said first and second indicia lines, said conical depression having an internal surface extending substantially from said upper surface to said lower surface and having an apex disposed substantially closer to said lower surface, said first and second indicia lines extending longitudinally to the apex along the internal surface of said conical depression;

(d) an indication of the proper alignment of the club occurring when said first and second indicia lines located on said internal surface form a straight right angled intersection at the apex when viewed by a player.

2. An alignment system according to claim 1, wherein the internal surface of the conical depression forms an acute angle of about 30° to 60° with the upper surface of the club.

3. An alignment system according to claim 2, wherein the acute angle between the internal surface of the depression and the upper surface is about 45°.

4. An alignment system according to claim 1, wherein a post is positioned at the intersection of said first and second indicia lines with the apex of the conical depression, said post extending upwardly from the apex in a direction perpendicular to the plane of the upper surface.

5. An alignment system according to claim 4, wherein the heighth of said post is even with the plane of the upper surface.

6. An alignment system according to claim 4, wherein the heighth of said post is less than the depth of the conical depression.

* * * * *